US007007671B2

(12) United States Patent
Nakayama et al.

(10) Patent No.: US 7,007,671 B2
(45) Date of Patent: Mar. 7, 2006

(54) FUEL INJECTION SYSTEM

(75) Inventors: Shinji Nakayama, Tokyo (JP); Susumu Kouketsu, Tokyo (JP); Keiki Tanabe, Tokyo (JP)

(73) Assignee: Mitsubishi Fuso Truck and Bus Corporation, Tokyo (JP)

( * ) Notice: Subject to any disclaimer, the term of this patent is extended or adjusted under 35 U.S.C. 154(b) by 0 days.

(21) Appl. No.: 11/094,477

(22) Filed: Mar. 31, 2005

(65) Prior Publication Data

US 2005/0268888 A1 Dec. 8, 2005

(30) Foreign Application Priority Data

Mar. 31, 2004 (JP) ..... 2004-106456

(51) Int. Cl.
*F02M 37/04* (2006.01)
*F02M 55/02* (2006.01)

(52) U.S. Cl. ..... 123/446; 123/467

(58) Field of Classification Search ..... 123/446, 123/447, 467, 510, 514
See application file for complete search history.

(56) References Cited

U.S. PATENT DOCUMENTS 4,372,272 A * 2/1983 Walter et al. ..... 123/467
4,485,789 A * 12/1984 Walter et al. ..... 123/467
4,605,166 A 8/1986 Kelly
5,697,342 A * 12/1997 Anderson et al. ..... 123/446
5,738,075 A 4/1998 Chen et al.
5,743,237 A 4/1998 Matta
5,878,720 A 3/1999 Anderson et al.
6,453,875 B1 9/2002 Mahr et al.
6,845,754 B1 1/2005 Pecheny et al.
6,910,462 B1 * 6/2005 Sun et al. ..... 123/445
2005/0034709 A1 * 2/2005 Augustin ..... 123/446

FOREIGN PATENT DOCUMENTS

JP 2002 539372 11/2002

* cited by examiner

*Primary Examiner*—Thomas Moulis
(74) *Attorney, Agent, or Firm*—Jacobson Holman PLLC

(57) ABSTRACT

A booster unit is provided in an injector of a fuel injection system. The booster unit includes a booster piston accommodated in a pressure chamber, and a discharge valve capable of discharging fuel in a backpressure chamber. A controller includes an indication-value setting step which sets an indication value of a target pressure in a common rail in correspondence to an engine operation state, a determination step which determines whether or not the indication value of the pressure in the common rail is in a direction of reduction to be lower in comparison to a previously set indication value, and a booster piston pseudo-operation step which opens the discharge valve at timing other than injection operation of the injector when the determination step has determined that the indication value is in the direction of reduction.

9 Claims, 5 Drawing Sheets

FUEL INJECTION SYSTEM

CROSS-REFERENCE TO RELATED APPLICATIONS

This application is based upon and claims the benefit of priority from prior Japanese Patent Application No. 2004-106456, filed Mar. 31, 2004, the entire contents of which are incorporated herein by reference.

BACKGROUND OF THE INVENTION

1. Field of the Invention

The invention relates to a fuel injection system having a booster unit for use with in an internal combustion engine, such as a diesel engine.

2. Description of the Related Art

Fuel injection systems of a boost type using a common rail system in a diesel engine are generally known. In a fuel injection system of this type, high pressure fuel is used as working fluid fed from the common rail to move a booster piston. The booster piston is provided between a pressure chamber and a backpressure chamber in an injector. The booster piston is moved in accordance with the differential pressure occurring between the pressure chamber and the backpressure chamber when the fuel in the backpressure chamber is discharged. The fuel intensified by the booster piston is transferred to a needle valve mechanism of a nozzle portion of the injector.

A fuel injection system is disclosed in, for example, Japanese patent document (PCT. National Publication No. 2002-539372). The fuel injection system disclosed therein includes a needle valve drive unit that actuates the needle valve of a needle valve mechanism. The needle valve drive unit includes a pressurization chamber that admits fuel fed from a common rail; an open/close valve capable of discharging fuel in the pressurization chamber; and a pressure-receiving piston accommodated in the pressurization chamber. The needle valve drive unit opens the needle valve in conjunction with the discharge of fuel being preserved in the pressurization chamber.

In fuel injection systems of the type described in the patent document, a large amount of fuel is used to operate the booster unit. As such, in comparison to a fuel injection system without a booster unit, a common rail with a large capacity is necessary depending on the type.

The common rail pressure is controlled to an optimal value through, for example, adjustment of the amount of feed from a supply pump in correspondence to the engine operation mode. For example, in the event that the engine is running at high load and high speed, the supply pump is controlled to cause the common rail pressure to be higher than in the event that the engine is running at low load and low speed.

Under these circumstances, demand arises in that the common rail pressure is controlled to lower in a short time in an engine transient state, such as in the event that the engine load state transitions from a high load state to a low load state, and the throttle opening (i.e., the degree of acceleration pedal operation) transitions from a large state to a small state. However, in a common rail having a relatively large capacity suited to a booster unit, it takes a time for pressure reduction, thereby causing a response delay. As such, there can occur high pressure injection of fuel in a low load state, wherein it is contemplated that inverse effects are imposed on exhaust gas, etc.

BRIEF SUMMARY OF THE INVENTION

Accordingly, the invention is to provide a fuel injection system that enables the pressure to be quickly reduced in response to an event where the necessity has arisen for reducing the pressure in the common rail in correspondence to the operation mode.

A fuel injection system of the present invention comprises a common rail, a booster unit, a needle valve drive unit, and a controller. The booster unit has: a pressure chamber which admits the fuel transferred from the common rail; an booster piston provided in the pressure chamber; a backpressure chamber which is separated by the booster piston from the pressure chamber and which admits the fuel transferred from the common rail; a discharge valve which is able to discharge the fuel existing in the backpressure chamber; and a booster chamber which, when the fuel in the backpressure chamber is discharged, uses a portion moving integrally with the booster piston thereby to intensify the fuel and then transfers the fuel to the needle valve mechanism. The needle valve drive unit has: a pressurization chamber which admits the fuel transferred from the common rail; an open/close valve which is able to discharge the fuel existing in the pressurization chamber; and a pressure-receiving piston which is accommodated in the pressurization chamber and moves in the direction of opening the needle valve in conjunction with discharge of the fuel existing in the pressurization chamber. And the controller has booster piston pseudo-operation means for opening the discharge valve of the booster unit at timing other than timing of injection operation of the injector in the event that necessity arises for reducing pressure in the common rail in correspondence to any one of an engine operation state and accelerator operation state.

According to the invention, in a fuel injection system using a booster unit and a common rail, the pressure in the common rail can be quickly reduced in response to an event where the necessity has arisen for reducing the pressure in the common rail, such as in an event where the state transitions from a high load state to a low load state in correspondence to the engine operation mode.

Since a discharge valve of an injector for an inoperative cylinder for which injection operation is not performed is opened by the booster piston pseudo-operation means, even in a state where the needle valve mechanism of the injector is closed and hence unable to inject the fuel, the pressure in the common rail is early reduced. Consequently, the internal pressure of the injector can be restrained from being excessively high, whereby structural integrity of the injector is secured.

According to a preferred embodiment of the present invention, the determination means sets the pressure-difference set value in correspondence to an engine speed and an engine load.

According to a preferred embodiment of the present invention, the booster piston pseudo-operation means opens the discharge valve of the injector for a cylinder for which injection operation is not performed.

According to a preferred embodiment of the present invention, the determination means causes the pressure-difference set value to increase as the engine speed and the engine load increase.

According to a preferred embodiment of the present invention, in a state where the booster piston pseudo-operation means is executed and the discharge valve is opened, the controller causes a feed rate of a supply pump to supply the fuel to the common rail to be reduced or to be zero.

According to another embodiment of the controller, the controller further has determination means for determining whether or not an accelerator opening is in a direction of reduction, and when the determination means has determined that the accelerator opening is in the direction of reduction, the booster piston pseudo-operation means opens the discharge valve at timing other than timing of injection operation of the injector.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
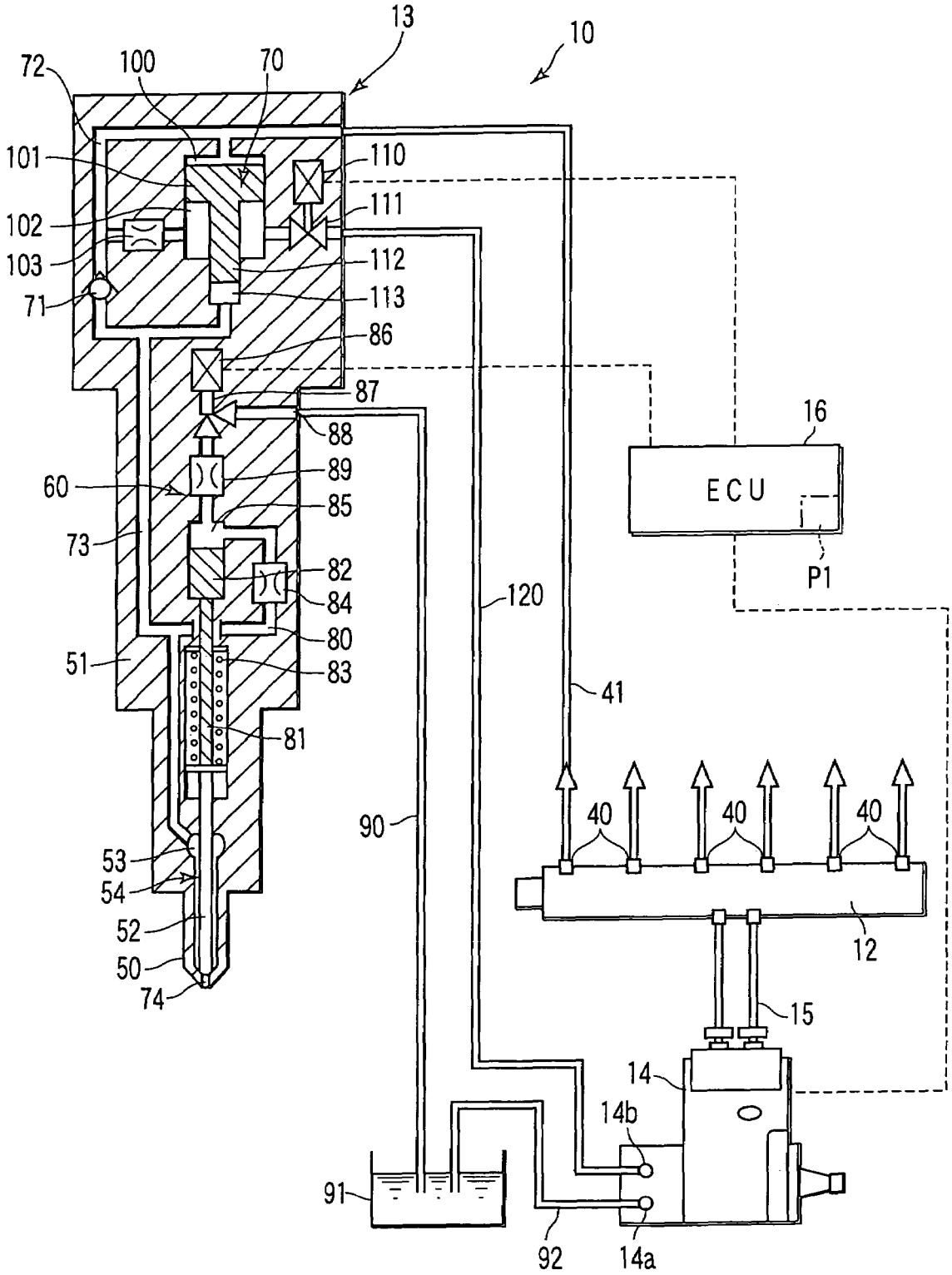
FIG. 1 is a cross sectional view showing a fuel injection system of a first embodiment according to the invention.
Figure 6:
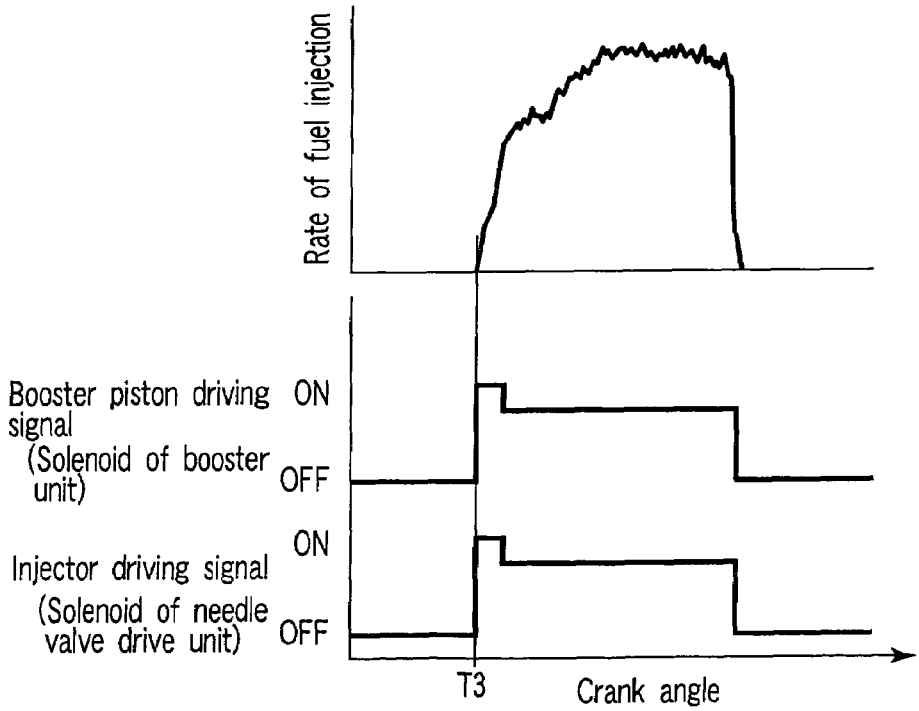
FIG. 6 is a diagram showing other examples of a booster piston driving signal and an injector driving signal in the fuel injection system shown in FIG. 1.

With reference to FIGS. 1 and 6, a first embodiment of the invention will be described herebelow.

FIG. 1 shows a fuel injection system 10 that is used in a diesel engine that is exemplified for an engine. The fuel injection system 10 includes members such as a common rail 12, an injector 13, and a supply pump 14 that functions as a fuel pump. The common rail 12 preserves pressurized fuel. The injector 13 is provided in units of a cylinder of the engine. The supply pump 14 pressurizes fuel and supplies the fuel to the common rail 12. The common rail 12 and the supply pump 14 are interconnected by fuel feed pipes 15. The supply pump 14 is controlled by a controller 16 for a discharge amount so that the fuel pressure in the common rail 12 becomes a fuel pressure of a desired value or zero.

A plurality of discharge ports 40 are formed in the common rail 12. The discharge ports 40 supply the fuel to the injectors 13 for the cylinders, respectively. Only one of the injectors 13 is shown in FIG. 1. Practically, however, the injectors 13 of the cylinders are, respectively, connected to the discharge ports 40 of the common rail 12 through a fuel feed passage 41, wherein the fuel is fed to the respective injectors 13.

The injector 13 includes a body 51 having a nozzle portion 50, a needle valve mechanism 54, a needle valve drive unit 60, and a booster unit 70. The needle valve mechanism 54 includes a needle valve 52 provided in a portion close to the nozzle portion 50, and a fuel chamber 53. The needle valve drive unit 60 moves the needle valve 52 along the direction of opening/closing the needle valve 52. The booster unit 70 intensifies the fuel fed from the common rail 12, thereby to feed the intensified fuel to the needle valve mechanism 54.

A fuel circulation portion 72 having a check valve 71 is formed in the injector 13. The fuel circulation portion 72 is connected to the common rail 12 through the fuel feed passage 41. The fuel fed from the common rail 12 is fed toward the fuel chamber 53 through the fuel circulation portion 72, the check valve 71, and a fuel circulation portion 73. The fuel circulation portion 73 is disposed in communication with the nozzle portion 50. A fuel injection hole 74 is formed to an end portion of the nozzle portion 50.

The needle valve drive unit 60 includes, for example, a fuel passage 80, a pressure-receiving piston 82, a spring 83, a pressurization chamber 85, an open/close valve 87, a return fuel outlet 88, and a orifice 89. The fuel passage 80 is formed in the body 51. The pressure-receiving piston 82 includes a drive shaft 81 that moves integrally with the needle valve 52 in the axial direction. The spring 83 urges the needle valve 52 in the closing direction. The pressurization chamber 85 is disposed in communication with the fuel passage 80 through an orifice 84. The open/close valve 87 is actuated by a solenoid 86. The return fuel outlet 88 is formed in communication with a discharge side of the open/close valve 87.

The return fuel outlet 88 is disposed in communication with a fuel tank 91 through a return passage 90. The return passage 90 is formed in communication with a discharge side of the open/close valve 87 of the needle valve drive unit 60 and with the fuel tank 91. The fuel tank 91 is placed in communication with an inlet 14*a* of the supply pump 14 through a fuel feed pipe 92.

The booster unit 70 includes a pressure chamber 100, a booster piston 101, and a backpressure chamber 102. The pressure chamber 100 is disposed in communication with the fuel feed passage 41. The booster piston 101 is accommodated in the pressure chamber 100. The backpressure chamber 102 is separated by the booster piston 101 from the pressure chamber 100. The backpressure chamber 102 is disposed in communication with the fuel circulation portion 72 through an orifice 103. High pressure fuel supplied from the common rail 12 through the fuel feed passage 41 is admitted into the pressure chamber 100 and the backpressure chamber 102.

The booster unit 70 further has a discharge valve 111, a plunger portion 112, and a booster chamber 113. The discharge valve 111 is driven by a solenoid 110 to open when the fuel preserved in the backpressure chamber 102 is discharged. The plunger portion 112 moves integrally with the booster piston 101 when the fuel in the backpressure chamber 102 is discharged. With the operation of the plunger portion 112, the booster chamber 113 pressurizes fuel.

The booster chamber 113 is disposed in communication with the fuel circulation portion 73. A fuel discharge passage 120 is connected to the outlet side of the discharge valve 111.

The fuel discharge passage 120 is coupled to an inlet side 14*b* of the supply pump 14. In this case, the fuel discharged from the backpressure chamber 102 can be returned to the inlet side 14*b* of the supply pump 14, thereby being able to save the fuel being supplied to supply pump 14.

The solenoid 86 of the open/close valve 87 and the solenoid 110 of the discharge valve 111 are individually controlled by the controller 16 for their opening/closing operation. The supply pump 14 is controlled by the controller 16 for the feed rate (pumping volumetric flow rate) of the fuel to the common rail 12. The controller 16 is formed using an in-vehicle computer such as an ECU (electronic control unit), for example. When the injector 13 requires intensification, the controller 16 controls the solenoid 110 of the booster unit 70 to turn ON. In synchronization with the above or with a slight delay after the above, the controller 16 controls the solenoid 86 of the needle valve drive unit 60 to turn ON.

As an indication-value setting means (or, an indication-value setting step) as defined in the appended claims of the invention, the controller 16 contains a computer program P1 ("program," hereafter) that sets a desired indication value of the common rail pressure corresponding to the operation mode of the engine. For example, the indication value of the common rail pressure is set corresponding to the engine speed and the engine load by use of a common rail pressure map exemplified in FIG. 2.

Figure 2:
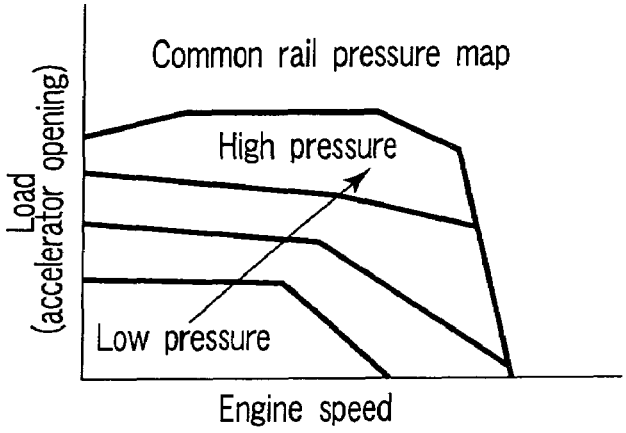
FIG. 2 is a view showing a common rail pressure map based on an engine speed and an engine load.

According to the common rail pressure map of FIG. 2, the indication value of the common rail pressure is set to increase as the engine speed and the engine load (accelerator opening) increase. In the present Specification, the "accelerator opening" corresponds to the amount of acceleration pedal operation. The operation of supply pump 14 is controlled so that the common rail pressure nears the indication value.

Figure 3:
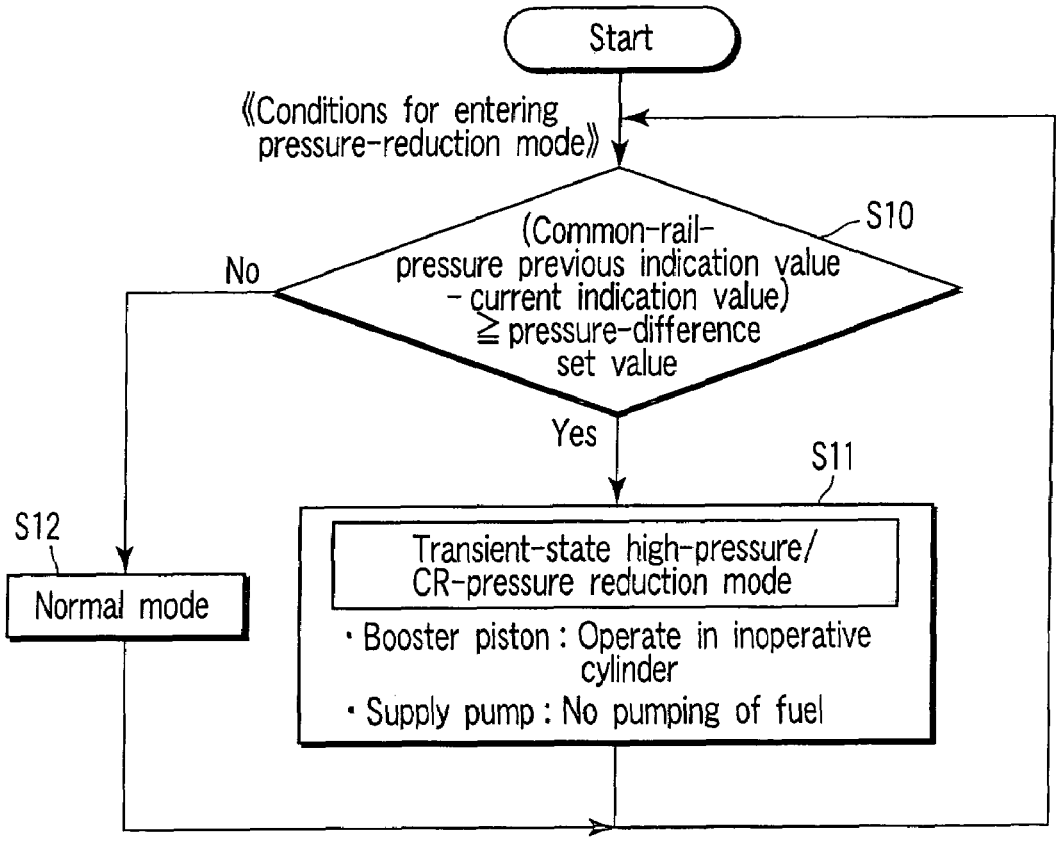
FIG. 3 is a view showing a part of functions of a controller of the fuel injection system shown in FIG. 1.

Further, the controller 16 includes a determination step S10 shown in FIG. 3, as determination means (or, a determination step) as defined in the appended claims of the invention. In the determination step S10, each time fuel injection is performed (or, at a predetermined interval), a program routine performs a comparison between a current indication value of the common rail pressure and a previously set indication value, thereby to determine whether or not the indication value is in the direction of reduction.

In the event that, in the determination step S10, the difference between the current indication value and the previous indication value has become greater than or equal to a preset pressure-difference set value, that is, the reducing amount in the indication value has exceeded a preset value, the operation proceeds to step S11 (pressure-reduction mode). Step 11 is executed as a booster piston pseudo-operation step S11 (booster piston pseudo-operation means as defined in the appended claims of the invention) as described below. In the present embodiment, the pressure-difference set value is set corresponding to the engine speed and the engine load (fuel injection rate). More specifically, as the engine speed and the engine load increase, the pressure-difference set value increases.

If in the determination step S10 the difference between the current indication value and the previous indication value is less than the preset pressure-difference set value, the operation proceeds to step S12 (normal mode). In step S12, the booster-piston driving signal remains OFF, as shown by a double-dotted chain line N1 in FIG. 4.

Figure 4:
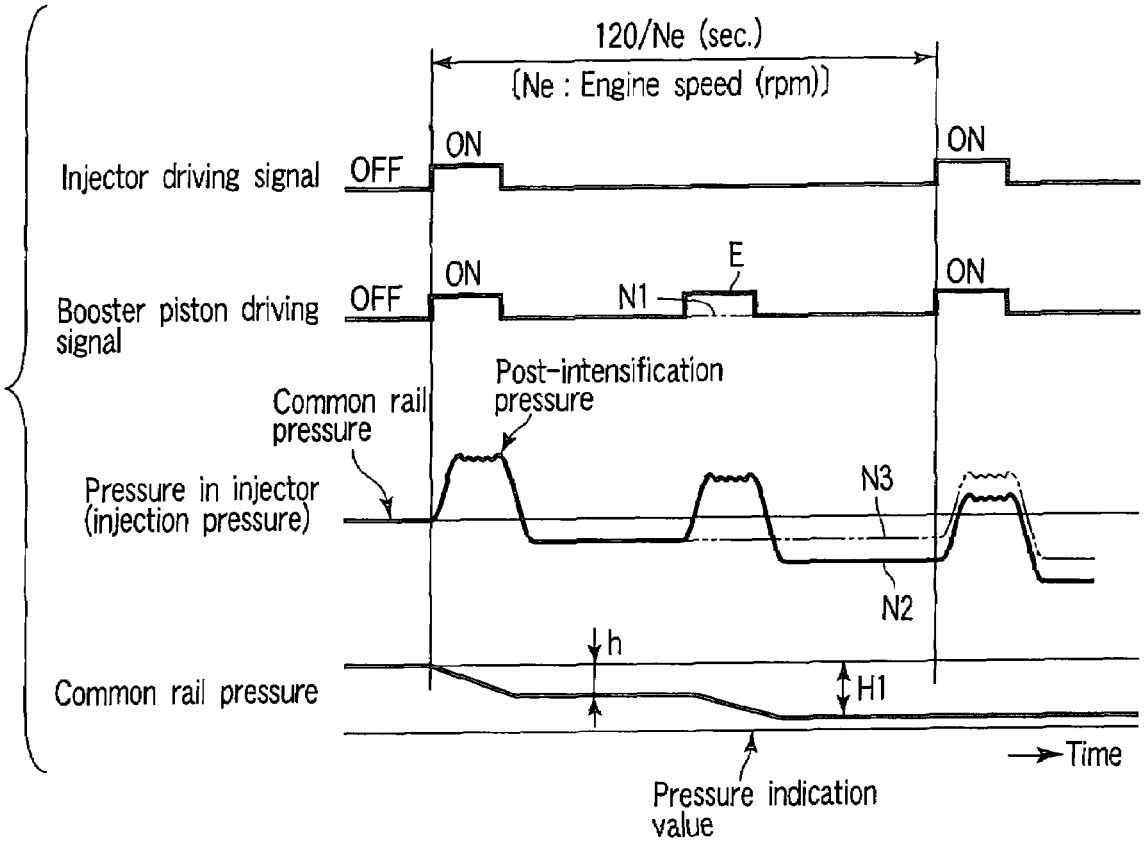
FIG. 4 is a diagram showing relationships between driving signals, injection pressures, and common rail pressures in the fuel injection system shown in FIG. 1.

In the booster piston pseudo-operation step S11, the discharge valve 111 of the booster unit 70 is opened at timing other than timing of the injection operation of the injector 13. More specifically, a booster piston driving signal as shown by a solid line E in FIG. 4 is output to turn on the solenoid 110 of the discharge valve 111, whereby the discharge valve 111 is opened.

The controller 16 further controls the operation of the supply pump 14. More specifically, while the discharge valve 111 is opened in the booster piston pseudo-operation step S11, the controller 16 controls the operation of the supply pump 14 so that the feed rate of fuel to the common rail 12 becomes zero (no-pumping). In this case, instead of controlling the supply pump 14 to the no-pumping state, pumping volumetric flow rate may be reduced to near zero.

Operation of the fuel injection system 10 according to the present embodiment will now be described herebelow with reference to FIGS. 1 to 6.

When the engine operates and the supply pump 14 is actuated, fuel drawn into the supply pump 14 from the fuel tank 91 is thereby pressurized. The pressurized fuel is then fed to the common rail 12. The pressure of fuel being discharged from the supply pump 14 is regulated by the controller 16 in correspondence to the operation mode of the engine. The fuel pressurized by the supply pump 14 to a predetermined pressure is preserved in the common rail 12.

The fuel is injected into a combustion chamber of the respective cylinder of the engine from the fuel injection hole 74 of the corresponding injector 13. The injector 13 is actuated in any one of a fuel intensification mode (mode in which the booster unit 70 operates) and fuel non-intensification mode (mode in which the booster unit 70 does not operate) in correspondence to the operation mode of the engine. For example, the injector 13 operates in the fuel intensification mode during high load operation of the engine. On the other hand, the injector 13 operates in a mode not requiring fuel intensification during low load operation, such as during idling of the engine.

Figure 5:
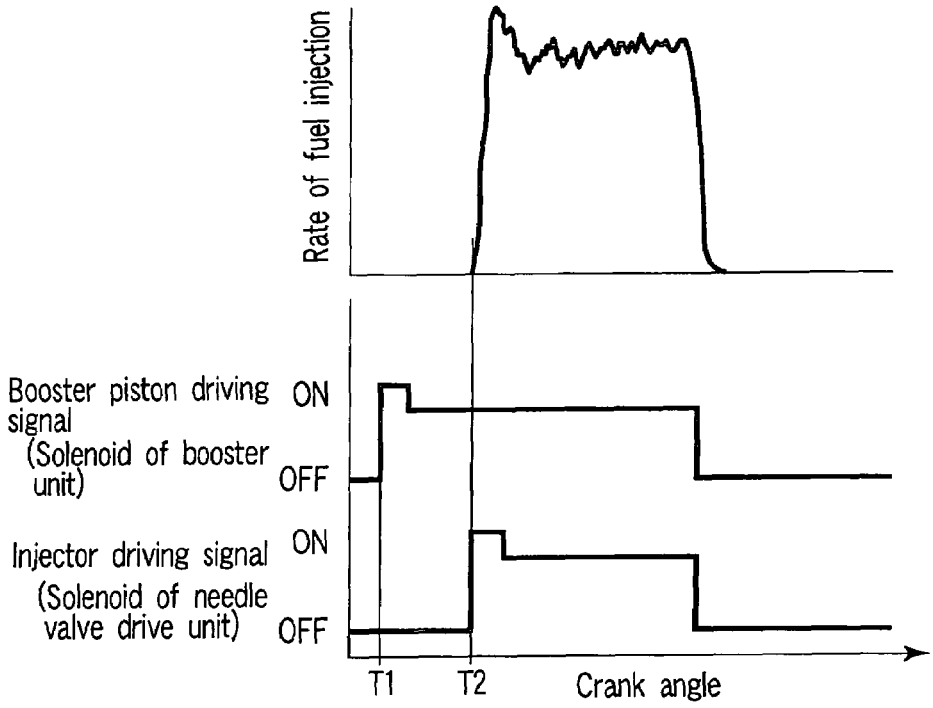
FIG. 5 is a diagram showing examples of a booster piston driving signal and an injector driving signal in the fuel injection system shown in FIG. 1.

With reference to FIG. 5, for example, in the fuel intensification mode, the solenoid 110 of the booster unit 70 is turned ON in response to a booster-piston driving signal at a crank angle T1 indicated on the horizontal axis of the figure. When the solenoid 110 is turned ON, the discharge valve 111 opens. Thereby, the booster piston 101 moves toward the booster chamber 113 in correspondence to a pressure-receiving area ratio between the booster piston 101 and the plunger portion 112. In conjunction with the movement, fuel in the backpressure chamber 102 is led to travel through the discharge valve 111 and is then discharged to the fuel discharge passage 120. Consequently, the fuel in the booster chamber 113 is intensified and transferred to the fuel circulation portion 73. The high pressure fuel discharged from the backpressure chamber 102 to the fuel discharge passage 120 is returned to the inlet side 14*b* of the supply pump 14.

At a crank angle T2 shown in FIG. 5, the solenoid 86 of the needle valve drive unit 60 is turned ON in response to an injector driving signal. When the solenoid 86 is turned ON, the open/close valve 87 opens. Thereby, the fuel in the pressurization chamber 85 is discharged from the return fuel outlet 88 to the return passage 90 through the open/close valve 87. With this operation, the pressure-receiving piston 82 is moved in the direction opposite to the needle valve 52, thereby to open the needle valve 52. Consequently, fuel in the fuel chamber 53 is injected into the combustion chamber of the engine from the fuel injection hole 74. The fuel discharged from the pressurization chamber 85 to the return fuel outlet 88 returns to the fuel tank 91.

Reference is now made to FIG. 6. As shown therein, depending on the operation mode of the engine, an event can occur in which the booster-piston driving signal and the injector driving signal are issued substantially at the same time at a crank angle T3. In this event, substantially at the same time the solenoid 110 of the booster unit 70 is turned ON, the solenoid 86 of the needle valve drive unit 60 is turned ON, whereby the fuel injection is started. As such, booting in the rate of fuel injection at the start time of injection is caused to be slow.

In the operation mode not requiring intensification for the injector 13, the solenoid 110 of the booster unit 70 remains OFF. In this mode, the solenoid 86 of the needle valve drive unit 60 is turned ON, and the open/close valve 87 opens. Thereby, the fuel in the pressurization chamber 85 is discharged to the return passage 90 from the open/close valve 87, similarly as the case described hereinabove. Concurrently, the pressure-receiving piston 82 moves toward the needle valve 52, and the needle valve 52 opens. When the needle valve 52 opens, the fuel is injected from the fuel injection hole 74. In this case, the fuel is injected only by using the pressure being exerted by the common rail 12, so that the injection pressure is relatively low.

The pressure in the common rail 12 is adjustable through adjustment of the pumping volumetric flow rate of the fuel being supplied from the supply pump 14 in correspondence to the operation mode of the engine. For example, in the mode of high load, high speed operation of the engine, the indication value is set to allow the pressure in the common rail to become higher by using the common rail pressure map as shown in FIG. 2.

As already described above, in the determination step S10 shown in FIG. 3 when the difference between the current indication value and the previous indication value has become greater than or equal to the preset pressure-difference set value, the operation proceeds to the booster piston pseudo-operation step S11. In step S11, the booster-piston driving signal is output at the timing other than the timing of the injection operation, thereby to open the discharge valve 111 of the booster unit 70.

For example, suppose now that in a six-cylinder engine, the sequence of fuel injection for cylinders No. 1 to No. 6 is: No. 1-No. 5-No. 3-No. 6-No. 2-No. 4. In this case, when fuel injection is performed for the cylinder No. 1, the booster-piston driving signal is output to both or any one of the cylinders No. 2 and No. 6 which are not performing the injection operation, thereby to open the discharge valve 111 of the booster unit 70.

In the event that the operation is proceeding to the booster piston pseudo-operation step S11, the driving signal of the injector 13 is OFF, so that the needle valve 52 is not opened during that event. Thereby, the booster piston 101 is essentially stopped. However, since the discharge valve 111 is opened, the fuel drawn into the backpressure chamber 102 through the fuel circulation portion 72 and the orifice 103 from the common rail 12 is discharged to the fuel discharge passage 120 through the discharge valve 111. Thereby, the pressure in the common rail 12 is reduced in a short time to a level close to the indication value.

N2 in FIG. 4 indicates an internal pressure of the injector after the execution of step S11. In comparison, the reduction amount in the internal pressure of the injector when step 11 is unexecuted is only an amount shown by N3 in FIG. 4. H1 in FIG. 4 indicates a reduction amount in the pressure in the common rail after the execution of step S11. In comparison, a reduction amount in the pressure in the common rail when step S11 is unexecuted is only an amount shown by h.

As described above, the controller 16 includes the booster piston pseudo-operation means (step 511). Accordingly, even with a fuel injection system 10 using a common rail 12 having a relatively large capacity for being used to operate the booster unit 70, in the transient state of the engine such as in the state of transition from a high speed, high load zone to a low speed, low load zone, the pressure in the common rail 12 can be reduced in a short time. Consequently, occurrence of a response delay in such a transient state can be restrained, high pressure fuel injection can be prevented from being executed in a low load state, and hence exhaust gas emissions can be maintained in a preferable condition. In particular, the control described above is effective to reduce NOx contained in exhaust gas emissions.

In addition, since step S11 is executed to thereby open the discharge valve 111 of the injector 13 for the inoperative cylinder for which injection operation is not performed, even in the state where the needle valve mechanism 54 of the injector 13 for the inoperative cylinder is closed and hence unable to inject the fuel, the pressure in the common rail 12 is early reduced. Consequently, the internal pressure of the injector 13 can be restrained from being excessively high, whereby structural integrity of the injector 13 is secured.

Figure 7:
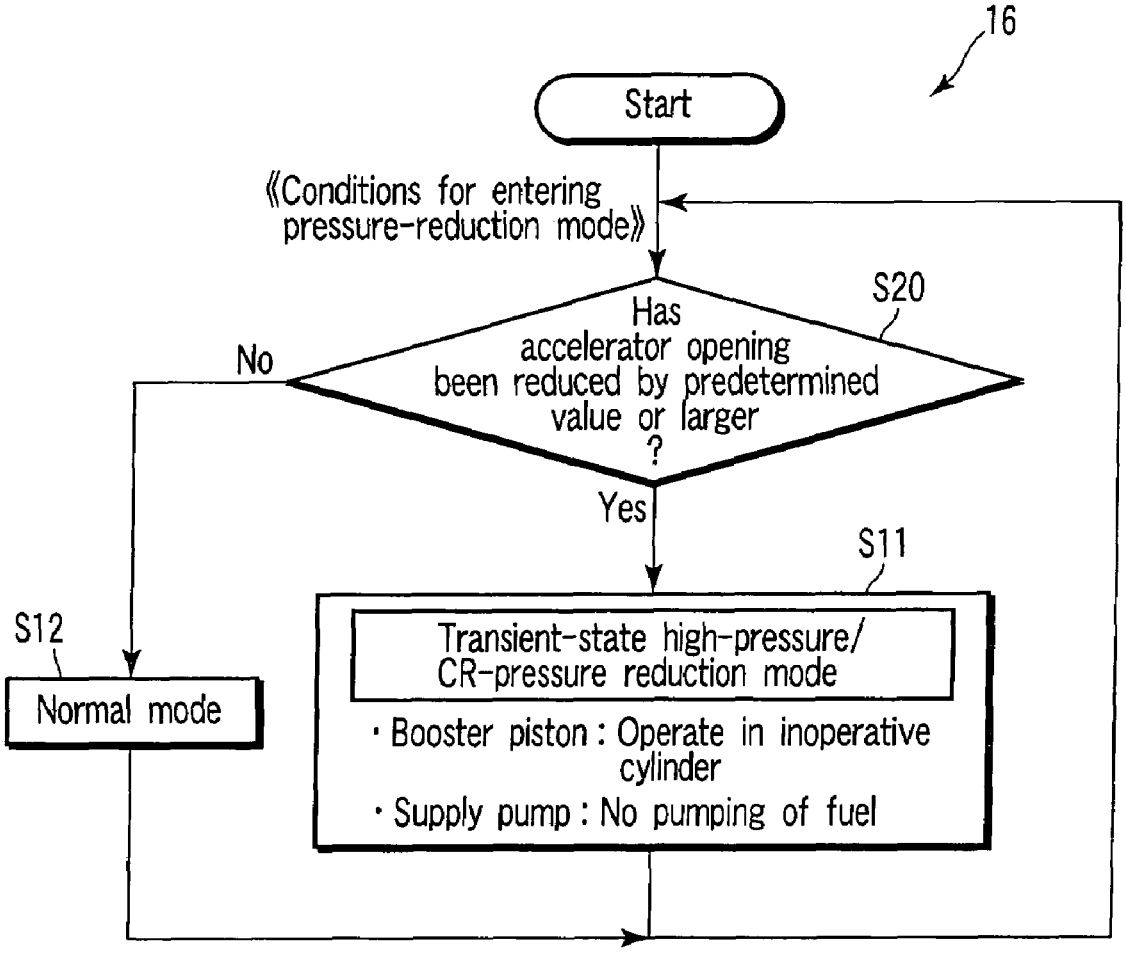
FIG. 7 is a view showing a part of functions of a controller according to a second embodiment of the invention.

FIG. 7 is a view showing a part of functions of a controller 16 according to a second embodiment of the invention. This embodiment includes a determination step S20 that functions as determination means for determining whether or not the accelerator opening is in a direction of reduction; and similarly as those in the first embodiment (FIG. 3), the embodiment includes a booster piston pseudo-operation step S11 (pressure-reduction mode) and a step S12 (normal mode). Configurations and operations of those other than the determination step S20 are common to those in the above-described first embodiment, so that the common portions are shown with the same numerals/symbols as in the first embodiment, and descriptions thereof are not repeated here.

In the determination step S20 of the embodiment, the accelerator opening (the amount of acceleration pedal operation) is used as a determination criterion of whether or not to reduce the indication value of the common rail pressure. That is, in the determination step S20 it is determined whether or not the accelerator opening is in the direction of reduction. When it is determined that the accelerator opening is in the direction of a significant reduction to be lower than a predetermined value (when an accelerator opening ratio has exceeded a set value), the operation proceeds to step S11. By the execution of step S11, the booster piston driving signal is output at the timing other than the timing of the injection operation of the injector 13, and the discharge valve 111 of the booster unit 70 is opened thereby.

Accordingly, in the transient state of the engine such as in the state of transition from a high speed, high load zone to a low speed, low load zone, the pressure in the common rail 12 can be reduced in a short time. Consequently, occurrence of a response delay in such a transient state can be restrained, high pressure fuel injection can be prevented from being executed in a low load state, and hence exhaust gas emissions can be maintained in a preferable condition.

The invention may of course be practiced or carried out in various ways other than the above-described embodiments by appropriately modifying constitutional elements, such as the injectors, common rail, and controller, without departing from the essence and the scope and spirit of the invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fuel injection system comprising:

a common rail which preserves a fuel pressurized;

a booster unit which intensifies the fuel supplied from the common rail thereby to transfer the fuel to a needle valve mechanism of an injector;

a needle valve drive unit which drives the needle valve of the needle valve mechanism to open or close; and a controller which controls the booster unit and the needle valve drive unit, wherein the booster unit has:

a pressure chamber which admits the fuel transferred from the common rail;

a booster piston provided in the pressure chamber;

a backpressure chamber which is separated by the booster piston from the pressure chamber and which admits the fuel transferred from the common rail;

a discharge valve which is able to discharge the fuel existing in the backpressure chamber; and a booster chamber which, when the fuel in the backpressure chamber is discharged, uses a portion moving integrally with the booster piston to thereby intensify the fuel and then transfers the fuel to the needle valve mechanism, the needle valve drive unit has:

a pressurization chamber which admits the fuel transferred from the common rail;

an open/close valve which is able to discharge the fuel existing in the pressurization chamber; and a pressure-receiving piston which is accommodated in the pressurization chamber and moves in the direction of opening the needle valve in conjunction with discharge of the fuel existing in the pressurization chamber, and the controller has:

booster piston pseudo-operation means for opening the discharge valve at timing other than timing of injection operation of the injector in the event that necessity arises for reducing pressure in the common rail in correspondence to any one of an engine operation state and accelerator operation state.

2. A fuel injection system according to claim 1, wherein the controller further comprises:

indication-value setting means for setting an indication value of a target pressure in the common rail in correspondence to the engine operation state; and determination means for comparing a current indication value of the pressure in the common rail with a previous indication value of the pressure in the common rail to thereby determine whether or not the current indication value is reduced by a pressure-difference set value or greater from the previous indication value, and when the determination means has determined that a difference between the current indication value and the previous indication value is greater than or equal to the pressure-difference set value, the booster piston pseudo-operation means opens the discharge valve at the timing other than the timing of the injection operation of the injector.

3. A fuel injection system according to claim 2, wherein the determination means sets the pressure-difference set value in correspondence to an engine speed and an engine load.

4. A fuel injection system according to claim 2, wherein the booster piston pseudo-operation means opens the discharge valve of the injector for a cylinder for which injection operation is not performed.

5. A fuel injection system according to claim 2, wherein the determination means causes the pressure-difference set value to increase as the engine speed and the engine load increase.

6. A fuel injection system according to claim 2, wherein, in a state where the booster piston pseudo-operation means is executed and the discharge valve is opened, the controller causes a feed rate of a supply pump to supply the fuel to the common rail to be reduced or to become zero.

7. A fuel injection system according to claim 1, wherein the controller further has determination means for determining whether or not an accelerator opening is in a direction of reduction, and when the determination means has determined that the accelerator opening is in the direction of reduction, the booster piston pseudo-operation means opens the discharge valve at timing other than timing of injection operation of the injector.

8. A fuel injection system according to claim 7, wherein the booster piston pseudo-operation means opens the discharge valve of the injector for a cylinder for which injection operation is not performed.

9. A fuel injection system according to claim 7, wherein, in a state where the booster piston pseudo-operation means is executed and the discharge valve is opened, the controller causes a feed rate of a supply pump to supply the fuel to the common rail to be reduced or to become zero.

* * * * *